United States Patent [19]

Davern

[11] Patent Number: 4,609,134

[45] Date of Patent: Sep. 2, 1986

[54] JET GUIDE RIVET INJECTOR

[75] Inventor: John W. Davern, North Tonawanda, N.Y.

[73] Assignee: Gemcor Engineering Corp., Buffalo, N.Y.

[21] Appl. No.: 687,509

[22] Filed: Jan. 4, 1985

Related U.S. Application Data

[63] Continuation of Ser. No. 278,212, Jun. 29, 1981, abandoned.

[51] Int. Cl.[4] ..... B21J 15/00; B21J 15/38

[52] U.S. Cl. ..... 227/112; 227/51; 227/114; 227/119; 406/86; 406/87

[58] Field of Search ..... 227/112, 114, 119, 51; 198/493; 221/278; 406/87, 86, 92

[56] References Cited

U.S. PATENT DOCUMENTS

| | | | |
|---|---|---|---|
| 2,732,554 | 1/1956 | Knott | 227/112 |
| 3,160,443 | 12/1964 | Harris et al. | 406/86 X |
| 3,275,047 | 9/1966 | Kulman | 144/32 |
| 3,324,697 | 6/1969 | Reiley | 227/112 X |
| 3,494,393 | 2/1970 | Casanov | 144/32 |
| 3,516,141 | 6/1970 | Rech | 227/115 |
| 3,647,129 | 3/1972 | Ehrlich | 227/112 |
| 3,918,706 | 11/1975 | Craft | 406/87 X |
| 3,946,926 | 3/1976 | Willis | 227/112 |
| 4,165,132 | 8/1979 | Hassan et al. | 406/87 X |
| 4,363,573 | 12/1982 | Ginther et al. | 221/278 X |

FOREIGN PATENT DOCUMENTS

| | | | |
|---|---|---|---|
| 0686750 | 1/1940 | Fed. Rep. of Germany | 221/278 |
| 2148396 | 4/1973 | Fed. Rep. of Germany | 227/112 |
| 55-11476 | 1/1980 | Japan | 406/87 |
| 1419371 | 12/1975 | United Kingdom . | |

OTHER PUBLICATIONS

O'Neill et al., Annular Orientor, IBM Technical Disclosure Bulletin, vol. 20, No. 2, pp. 593-594, 7/1977.

*Primary Examiner*—Robert L. Spruill
*Assistant Examiner*—Taylor J. Ross
*Attorney, Agent, or Firm*—Christel, Bean & Linihan

[57] ABSTRACT

Air pressure means for maintaining rivets in axial alignment as they pass through a feed tube to a riveting machine. The air pressure means comprises a circumferentially spaced series of air discharge passages directed obliquely toward the axis of the feed tube and in the direction of travel of the rivets whereby a conical pattern of air pressure is directed against the shanks of the rivets to urge them into axial alignment in the feed tube.

9 Claims, 4 Drawing Figures

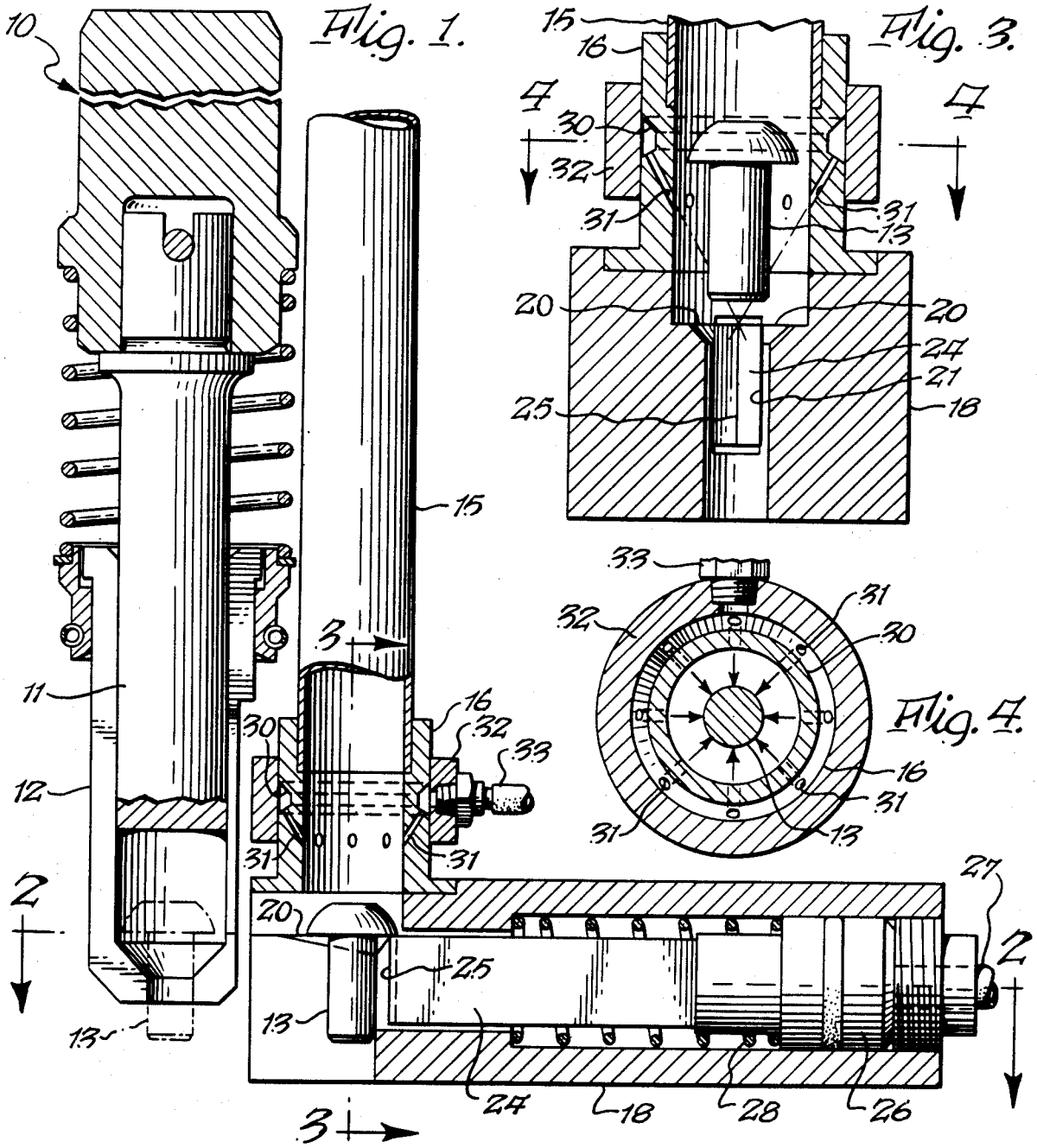
Fig. 1.
Fig. 3.
Fig. 4.
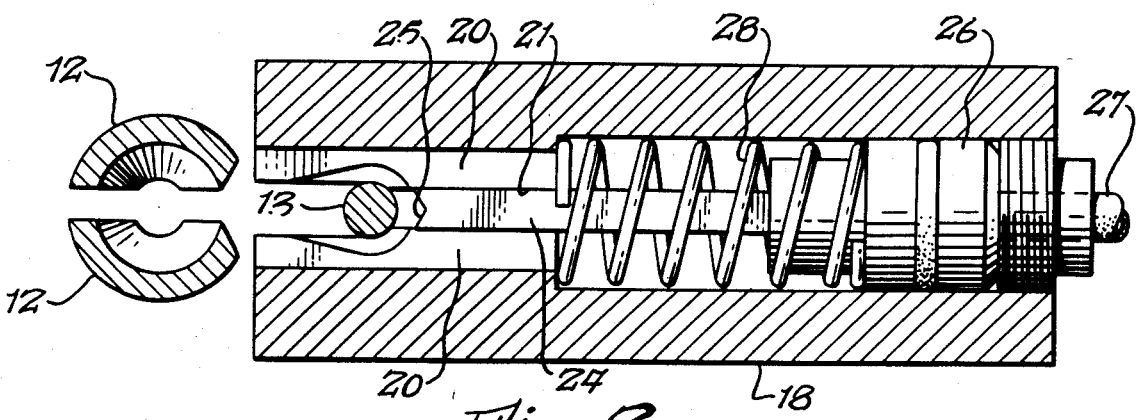
Fig. 2.

JET GUIDE RIVET INJECTOR

This application is a continuation of application Ser. No. 278,212 filed June 29, 1981 abandoned.

BACKGROUND OF THE INVENTION

The present invention relates to the feeding of rivets or other fasteners or similar articles to riveting or other fastener inserting means.

In riveting machines the rivet blanks having heads at one end of each are commonly fed to the riveting apparatus by passing them downwardly through a feed tube and thence laterally to rivet receiving fingers which support the same and insert them through holes in workpieces to be riveted. Passage of the rivet blanks downwardly through the feed tube may be by gravity alone or by air pressure against rivet blanks downwardly through the feed tube.

The present invention provides means to prevent cocking of rivet blanks in the feed tube which interferes with feeding thereof and also makes it possible to employ the rivet feeding mechanism in any orientation, including an upside-down orientation with respect to conventional downwardly moving rivet blanks.

In U.S. Pat. No. 3,647,129 to Ehrlich, air pressure is employed to direct successive rivet blanks laterally from the feed tube into a rivet receiving channel extending at right angles to the feed tube.

In U.S. Pat. No. 3,906,615 to Campbell, Jr. et al, the rivet blanks are free to cock as they move along the feed tube but are ultimately straightened by movement into engagement with an O-ring at the discharge end of the feed tube, if, in fact, they ultimately reach such discharge end.

In U.S. Pat. No. 3,946,926 to Willis, as best shown in FIG. 6 thereof, air is permitted to bleed off from beneath the fasteners to permit their free downward flow. The individual fasteners are introduced into the feed channel by way of an inlet passage 62 which intersects the feed channel and are moved upwardly by air pressure from such passage to a position where they abut the rivet driving device.

In U.S. Pat. No. 4,194,665, air pressure is merely employed to actuate the staple driving element which is in the form of a pneumatic hammer.

None of the patents referred to above or known to the applicant or his attorney approach the construction shown and claimed herein or provide air pressure means for maintaining rivet blanks against cocking during their passage to the riveting means through a feed tube.

SUMMARY OF THE INVENTION

In the present invention, the invisidual rivets are fed usually downwardly through a feed tube and come to rest upon side rail formations from which they are moved laterally to conventional rivet holding fingers. The present invention relates entirely to means for preventing cooking of the rivet blanks in their passage through the feed tube and insuring their axial alignment regardless of the position or orientation of the feed tube.

This result is accomplished by an air jet arrangement which surrounds the feed tube and includes a series of circumferentially spaced air passages which are each directed angularly toward the feed tube axis and in the direction of movement of the individual rivets whereby they form a conical air pressure pattern which acts against the shanks of the individual rivets and thus maintains them in axial alignment in the feed tube.

BRIEF DESCRIPTION OF THE DRAWING

FIG. 1 is a general cross-sectional view on a vertical plane showing one form of the apparatus of the present invention;

FIG. 2 is a cross-sectional view of the apparatus taken on the line 2—2 of FIG. 1;

FIG. 3 is a pigmentary cross-sectional view on the line 3—3 of FIG. 1 and FIG. 4 is a cross-sectional view on the line 4—4 of FIG. 3.

DESCRIPTION OF THE ILLUSTRATED EMBODIMENT

In FIG. 1 the numeral 10 designates generally the upper anvil structure of a riveting machine which structure is conventional and well known. The anvil, per se, is designated 11 and extends downwardly into a pair of rivet receiving fingers 12 which is likewise conventional in the riveting machine art. The individual rivets, designated 13, are moved laterally to a position between the fingers 12 with the heads of the rivets uppermost and the shank portions extending downwardly as shown in dot and dash lines at 13 in FIG. 1. The position of individual rivets prior to their horizontal movement to the rivet fingers is shown in full lines in FIG. 1.

Reference will now be had to the novel position of the present apparatus in which individual rivets are moved downwardly through a rivet feed tube 15. In conventional rivet feeding tubes the rivets are dropped into the feed tube individually with their heads uppermost and are then moved laterally into engagement with rivet fingers 12.

The present invention provides means to maintain individual rivets in vertical alignment and prevent cocking thereof in the feed tube and also provides for feeding rivets in proper axial orientation in any position of the rivet feeding mechanism, including an upside-down position in which case the rivets would be blown upwardly through the feed tube 15 by air pressure.

As illustrated in FIG. 3 on a somewhat enlarged scale the lower end of tube 15 fits within a collar 16 the interior of which forms a continuation of the feed tube 15. Collar 16 is supported upon a horizontally extending bracket 18 which is attached to the riveting machine. Referring particularly to FIG. 1, rivets 13 having heads at their upper ends drop downwardly so that the rivet heads normally rest upon spaced ledges 20 formed by a slot 21 in bracket 18 as shown in FIG. 2.

A bar 24 is longitudinally slidable in slot 21 and has a V-shaped nose portion 25 adapted to engage successive rivets on ledges 20 and move them horizontally to engagement with conventional receiving fingers 12. Bar 24 is fixed to a piston 26 and an air pressure connection 27 moves piston 26 and bar 24 against the resistance of a coil spring 28.

The novel portion of the present rivet feeding apparatus is best shown in FIGS. 3 and 4 and in the present instance takes the form of a beveled annular groove 30 in collar 16 and a series of circumferentially spaced downwardly extending angular passage 31 directed obliquely toward the axis of the feed-tube 15. The beveled groove 30 is closed by a collar 32 and a source of air pressure is introduced to groove 30 by a connection 33 thereby defining a plenum. Thus air is projected in a downwardly conical path as shown by the dot and dash lines in FIG. 3 and impinges against the shanks of rivets 13 to urge such shanks toward a coaxial position with respect to feed tube 15 and collar 16.

A typical embodiment of the present invention has been described herein and shown in the accompanying drawing to illustrate the underlying principles of the invention, but it is to be understood that numerous modifications may be made without departing from the broad spirit and scope of the invention.

I claim:

1. Apparatus for feeding and aligning rivets wherein each rivet has a head portion, a shank portion of smaller cross-section extending therefrom, and an axis extending longitudinally of said shank portion, said apparatus comprising a feed tube terminating at one end, said rivets travelling uninterruptdd along said feed tube in a direction toward said one end with said shank portion disposed forwardly of said head portion, means for receiving and supporting rivets upon leaving said feed tube, said one end of said feed tube being adjacent said rivet receiving and supporting means so that upon leaving said feed tube said rivets come to rest on said receiving and supporting means; and means for aligning rivets or the like as they pass through said feed tube with their axes in general alignment with the axis of said feed tube, said means comprising a circumferentially spaced series of air inlet passages near said one end of said feed tube and near said rivet receiving and supporting means for discharging air into said feed tube and directed obliquely toward the axis of said feed tube and in the general direction of movement of the rivets and toward said one end of said feed tube and toward said rivet receiving and supporting means to cause air to enter the feed tube in a generally conical pattern converging substantially at the axis of said feed tube and in the direction of movement of the rivets to impinge against the shanks of the moving rivets and thus establish and maintain axial alignment thereof as said rivets leave said feed tube and come to rest on said rivet receiving and supporting means.

2. Apparatus according to claim 1 wherein said means for aligning rivets comprises a plenum encircling said tube, a collar encircling said plenum to enclose the plenum, means for introducing air pressure into said plenum, said series of air inlet passages extending from said plenum to the interior of said feed tube to establish said conical air flow pattern.

3. Apparatus according to claim 2 wherein said feed tube has an upper portion and a lower portion and wherein said plenum is disposed adjacent to the lower portion of said feed tube.

4. Apparatus according to claim 1 wherein said feed tube terminates at its lower end in a bracket which provides a slot for receiving the shank portions of rivets moving to said slot.

5. Apparatus according to claim 4 including horizontally movable means for engaging the shank portions of said rivets to move the rivets laterally to engagement with conventional rivet engaging fingers.

6. Apparatus according to claim 2 wherein said feed tube terminates at its lower end in a bracket which provides a slot for receiving the shank portions of rivets moving to said slot.

7. Apparatus according to claim 2 including horizontally movable means for engaging the shank portions of said rivets to move the same laterally to engagement with conventional rivet engaging fingers.

8. Apparatus according to claim 1, wherein said rivet receiving and supporting means provides a slot having ledges along each side of said slot for receiving the shank portions of aligned rivets moving to said slot and with the head portions of the rivets resting on said ledges.

9. Apparatus according to claim 8, further including laterally movable means for engaging the shank portions of the rivets to move the same laterally into engagement with conventional rivet engaging fingers.

* * * * *

UNITED STATES PATENT AND TRADEMARK OFFICE

CERTIFICATE OF CORRECTION

PATENT NO. : 4,609,134

DATED : September 2, 1986

INVENTOR(S) : John W. Davern

It is certified that error appears in the above-identified patent and that said Letters Patent are hereby corrected as shown below:

In claim 1, column 3, line 17,"uninterruptdd" should be --uninterrupted--.

Signed and Sealed this

Eleventh Day of November, 1986

*Attest:*

DONALD J. QUIGG

*Attesting Officer* *Commissioner of Patents and Trademarks*